United States Patent [19]

Timm et al.

[11] Patent Number: 4,923,512

[45] Date of Patent: May 8, 1990

[54] COBALT-BOUND TUNGSTEN CARBIDE METAL MATRIX COMPOSITES AND CUTTING TOOLS FORMED THEREFROM

[75] Inventors: Ed E. Timm, Traverse City; Douglas B. Schwarz, Midland, both of Mich.

[73] Assignee: The Dow Chemical Company, Midland, Mich.

[21] Appl. No.: 334,840

[22] Filed: Apr. 7, 1989

[51] Int. Cl.[5] ..... C22C 29/02

[52] U.S. Cl. ..... 75/239; 75/237; 75/240; 419/15; 419/16; 419/18; 419/23; 419/28; 419/29; 419/37; 419/45; 419/54; 419/57; 419/60

[58] Field of Search ..... 428/552, 547; 419/8, 419/49, 23, 14, 56, 48, 15, 16, 18, 28, 29, 37, 49, 54, 57, 60; 75/236, 237, 240

[56] References Cited

U.S. PATENT DOCUMENTS

| | | | |
|---|---|---|---|
| 4,341,557 | 7/1982 | Lizenby | 75/223 |
| 4,428,906 | 1/1984 | Rozmus | 419/48 |
| 4,610,931 | 9/1986 | Nemeth et al. | 428/547 |
| 4,630,092 | 12/1986 | Ecer | 419/8 |
| 4,649,084 | 3/1987 | Hale et al. | 428/552 |
| 4,656,002 | 4/1987 | Lizenby et al. | 419/10 |
| 4,744,943 | 5/1988 | Timm | 419/10 |
| 4,753,678 | 6/1988 | Maruyama et al. | 75/238 |
| 4,828,584 | 5/1989 | Cutler | 51/307 |

OTHER PUBLICATIONS

Kelto, C. A., in Metals Handbook, vol. 7, pp. 542–546 (1984).

Kenneth J. A. Brookes in FIGS. 2.37 through 2.44, pp. 30–31, of *Cemented Carbides for Engineers and Tool Users,* International Carbides Data (1983).

Kenenth J. A. Brookes, *Cemented Carbides for Engineers and Tool Users,* International Carbide Data (1983), pp. 17–18.

H. C. Lee and J. Gurland in "Hardness and Deformation of Cemented Tungsten Carbide", Materials Science and Engineering, 33 (1978), pp. 125–133.

E. E. Timm, in "The ROC Process: Densification of WC-Based Hard Materials with the Dow Isostatic Foreign Process", *Advances in Hard Materials Production London,* 11–13, Apr. 1988.

R. K. Viswanadham and J. D. Vanbles, "A Simple Method for Evaluating Cemented Carbides", *Metallurgical Transactions A,* vol. 8A, Jan. 1977, pp. 187–191.

H. F. Fischmeister, in "Development and Present Status of the Science and Technology of Hard Materials", *Science of Hard Materials,* New York (1983) pp. 14–15.

Tipnis, "Cutting Tool Wear", *Wear Control Handbook,* pp. 891–893.

*Primary Examiner*—Stephen J. Lechert, Jr.
*Attorney, Agent, or Firm*—D. R. Howard

[57] ABSTRACT

Cobalt-bound tungsten carbide metal matrix composites having a unique microstructure are produced by consolidating partially sintered greenware under high pressures, e.g., 120,000 psi, at temperatures less than those used for conventional liquid phase sintering in a relatively short time, e.g., from less than one minute to less than about one hour. The composites have a binder phase which contains less than about 80 weight percent of the tungsten found in a composite prepared from the same or similar compositions via liquid phase sintering. These composites provide cutting tools with both toughness and wear resistance which exceed that of cutting tools made from the same or similar compositions via liquid phase sintering.

12 Claims, 1 Drawing Sheet

COBALT-BOUND TUNGSTEN CARBIDE METAL MATRIX COMPOSITES AND CUTTING TOOLS FORMED THEREFROM

BACKGROUND OF THE INVENTION

The present invention generally concerns cemented tungsten carbide metal matrix composites. The present invention particularly concerns cobalt-bound tungsten carbide metal matrix composites. The present invention more particularly concerns cobalt-bound tungsten carbide metal matrix composites having a unique microstructure and the use of such composites in cutting tool applications.

Based on considerations of strength, hardness, and toughness, cobalt is the best binder for tungsten carbide-based metal matrix composites. The reasons for the exceptional performance of this system are not clear. However, the wetting of tungsten carbide by cobalt, the solubility of tungsten carbide in cobalt, the adhesion of cobalt to tungsten carbide, and the strength characteristics of thin cobalt films containing carbon and tungsten all contribute to this performance. This system is not without its drawbacks as well. A complex intermetallic carbide with the general formula $Co_3W_3C$ is easily formed with disastrous results on material properties Tungsten carbide/cobalt powder compacts are usually densified by sintering at temperatures at which cobalt is a eutectic liquid. This liquid dissolves a significant fraction of the tungsten carbide grains, especially the smaller ones. As the system is cooled the liquid becomes supersaturated and precipitates solid material. If the material contains the correct amount of carbon, the solid phases precipitated are tungsten carbide and cobalt-tungsten-carbon binder alloy. The tungsten carbide is precipitated on preferred planes of existing tungsten carbide crystals, causing the characteristic angular-shaped grains found in liquid phase sintered composites. If the total carbon content of the cooling cobalt-tungsten-carbon solution is too high, graphite will precipitate, as well as tungsten carbide and cobalt-tungsten-carbon alloy. If the total carbon content is too low, intermetallic carbides called eta phases will precipitate in addition to tungsten carbide and cobalt-tungsten-carbon alloy.

Precipitation of graphite or eta phases during cooling due to incorrect carbon content results in a ceramic/-metal composite (hereinafter "cermet") with very inferior properties. This phenomena also occurs through diffusional mechanisms in material processed in the solid state below the cobalt liquidus. Total carbon in tungsten carbide/cobalt metal matrix composites must be controlled to within 0.1% or less to produce acceptable material.

Tools made of cemented carbide, including WC-Co (tungsten carbide-cobalt) as a typical composition, are widely used in the machining field. The alloy compositions, characteristics, uses and applications of such cemented carbide materials are summarized in *Cemented Carbides for Engineers and Tool Users,* International Carbide Data (1983).

In the early 1980's Viswanadham and Venables, in an article entitled "A Simple Method for Evaluating Cemented Carbides", Metallurgical Transactions A, Volume 8A, January 1977, pages 187–91, demonstrate the existence of a relationship between the hardness and toughness of cermet materials. It has long been known that the harder a material is the more it is likely to fail by crack propagation. That is, the harder the material the more it lacks toughness. Viswanadham and Venables quantify this effect by showing that for a given cermet system the hardness of the material is inversely related to a measure of its toughness, W. W, the Palmqvist crack resistance, is the increase in applied load needed to cause an existing crack to extend one millimeter in a standardized testing protocol. As the hardness of a cermet changes by altering the amount of binder or the grain size of the ceramic component, the crack resistance varies inversely to the hardness.

Tipnis, in "Cutting Tool Wear", *Wear Control Handbook.* pages 891–893, notes that wear is the preferred failure mode for cutting tools. Other failure modes such as fracture, chipping, softening or thermal cracking are too erratic and lead to catastrophic and erratic failures. Although wear is the preferred mode, Tipnis cautions that no predictive tool wear theories are available. As such, the practical approach involves generation and application of tool wear data to balance workpiece material removal rates and economical tool life.

Tipnis summarizes basic requirements for a "cutting tool as follows: (a) it must be harder than the material being cut so as to resist the forces generated: (b) it must be tough so as not to fracture under the forces: (c) it must withstand high temperatures generated at the tool-chip interface without deforming: and (d) it must not wear too rapidly." "The most important properties for a cutting tool material are: hot hardness (i.e., resistance to softening under temperatures generated at the cutting edge of the tool), toughness (i.e., resistance to fracture under impacts), chemical stability and reactivity (i.e., the resistance to dissociation and transformation under temperatures and pressures generated at the cutting edge), and tendency towards diffusion of elements (i.e., resistance to cratering at high cutting temperatures."

H. F. Fischmeister, in "Development and Present Status of the Science and Technology of Hard Materials", *Science of Hard Materials,* Viswanadham, R. K., Rowcliff, D. J. and Gurland, J., eds., Plenem ( Press, New York (1983) pages 14–15, notes that several researchers have discovered that the properties of the cobalt binder phase in tungsten carbide/cobalt metal matrix composites are strongly affected by its content of dissolved tungsten and carbon, which can vary from 2 to 26% for tungsten and from 0.04 to 0.12% for carbon, according to a constant solubility product. Fischmeister suggests that "this means that small changes of the carbon content, which will result from varying the carbon activity of the sintering atmosphere, will produce great changes in the tungsten content of the binder." "Tungsten affects the binder properties either by solid solution strengthening, which is strong because of the large difference in atomic radii, or by precipitation of intermetallic phases. There may also be an indirect effect due to an influence of tungsten content on the grain size of the binder phase."

Those who use cemented carbide cutting tools face conflicting needs. They require sufficient strength or toughness to start a cut without chipping or destroying the tool's cutting edge. They also require enough hardness or wear resistance to keep a cut going once it is started. They cannot, however, increase the toughness too much in order to make sure that cutting tools do not fail in starting a cut without significantly reducing cutting tool life due to inadequate wear resistance. They also cannot obtain an excessive increase in hardness to markedly reduce cutting edge wear rate without significantly increasing the likelihood of cutting tool failure during initiation of cutting.

As used herein, the term "toughness" refers to resistance to premature failure, particularly during initiation of cutting, of a cemented carbide cutting tool It does not necessarily equate to KIC or other room temperature fracture mechanics definitions of toughness. Cutting performance does not correlate well with data supporting these definitions.

It would be desirable if there were available a method of manufacturing cemented carbides which promoted use of harder carbides without significantly reducing toughness of the resultant cemented carbide. A cemented carbide having greater toughness and wear resistance than presently available materials would also be desirable.

SUMMARY OF THE INVENTION

In view of the foregoing, the present invention is a substantially fully dense article of manufacture suitable for use in cutting tool applications, said article being formed from a powdered composition comprising tungsten carbide in an amount of from about 82 to about 99 percent by weight of composition and cobalt in an amount of from about 1 to about 18 percent by weight of composition and having a unique microstructure, the microstructure comprising tungsten carbide grains having a mean grain size of less than about five microns, and a binder phase, the binder phase being substantially free of graphite and complex, intermetallic carbides and comprising, tungsten, cobalt and carbon, the tungsten in the binder phase being present in an amount of less than about eighty percent of that present in the binder phase of an article prepared by liquid phase sintering the same powdered composition at a temperature sufficient to provide substantially complete densification in the absence of external pressure. As used herein, the term "substantially free" means not detectable by current analytical techniques.

BRIEF DESCRIPTION OF THE DRAWING

The FIGURE is a graphic portrayal of the data presented in Table IV. Table IV is a compilation of analytical test data concerning binder phase chemistry of Example 1 and Comparative Examples A and B. The vertical axis represents the weight percent of tungsten (W) in the binder (cobalt) phase. The horizontal axis represents the size of binder (cobalt) phase areas examined by Analytical Transmission Electron Microscopy (areas less than 0.5 microns) or Electron Microprobe Analysis (areas greater than 0.5 microns).

DETAILED DESCRIPTION OF THE INVENTION

Figure 1:
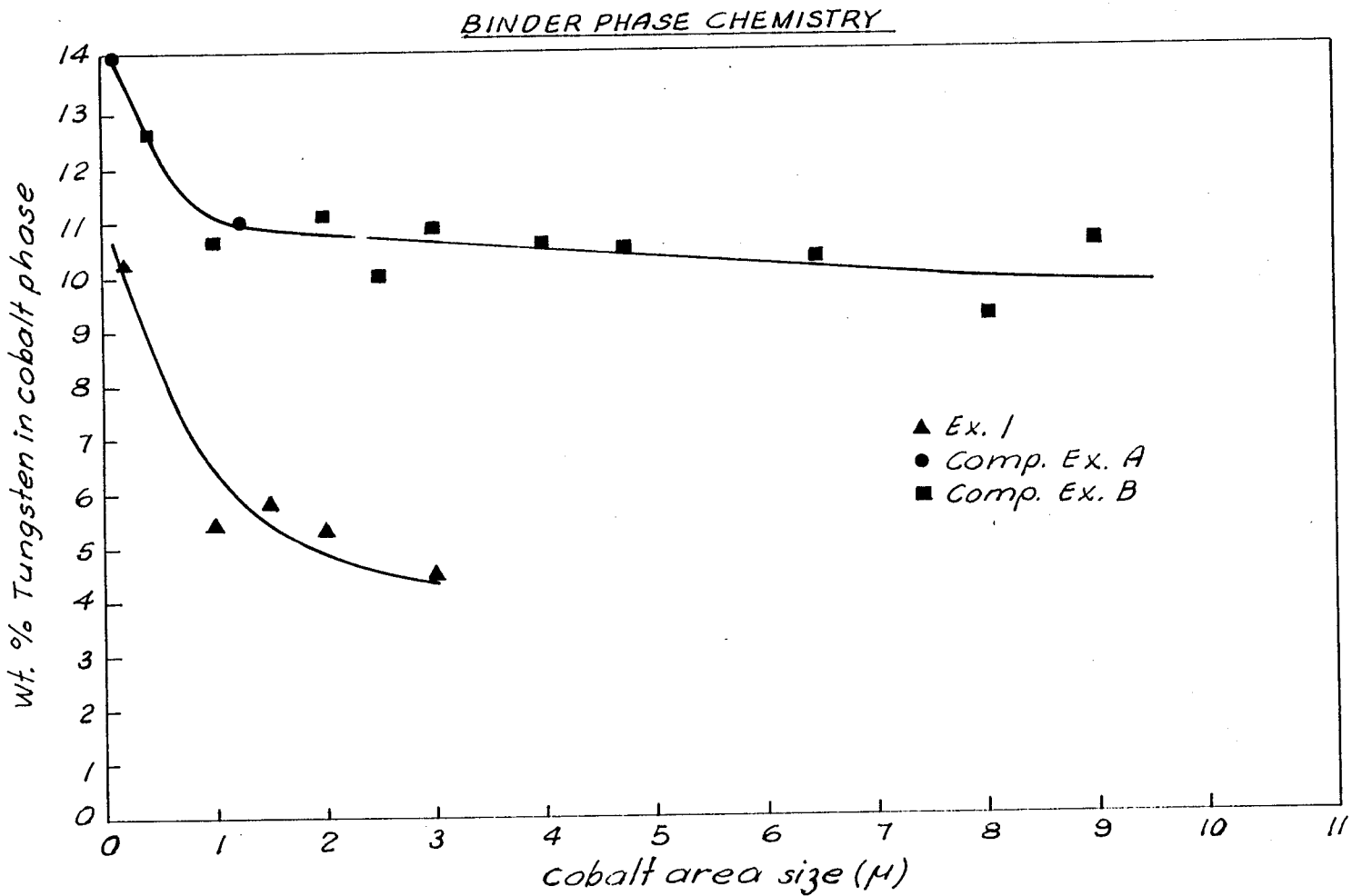

A common productivity measure for machining operations is stated in terms of total amount of metal removed from a workpiece per unit of time. Parameters specific to cutting tool performance include the material being cut, cutting speed, depth of cut, feed rate and tool life.

When discussing the materials science of metal matrix composites, one should distinguish between intrinsic properties of a material as measured on a microscopic scale, and extrinsic properties of the material measured from performance of a fabricated piece in a specific test. Intrinsic properties include hardness, resistance to crack propagation or toughness, grain-size distribution, binder film thickness and distribution, and chemistry of the various phases. Extrinsic properties include strength, wear resistance, cutting performance, and others which must be statistically determined from testing of macroscopic fabricated parts.

Powder Preparation

The powder used to fabricate tungsten carbide/-cobalt composite articles is suitably that known in the hardmetals industry as grade mix powder. Any particular grade of this powder contains a physical mixture of tungsten carbide, cobalt, paraffin wax, and lampblack. The principal impurities are oxygen, which exists as cobalt and tungsten oxides, and tramp particulates. This material is produced by wet attrition milling of the ingredients using tungsten carbide cermet balls and heptane. Spray drying the resultant slurry results in a free-flowing powder ready for subsequent pressing.

The powder suitably contains tungsten carbide in an amount of from about 82 to about 99 percent by weight of composition and cobalt in an amount of from about 1 to about 18 percent by weight of composition. The powder beneficially contains tungsten carbide in an amount of from about 85 to about 99 percent by weight of composition and cobalt in an amount of from about 1 to about 15 percent by weight of composition. The powder desirably contains tungsten carbide in an amount of from about 88 to about 99 percent by weight of composition and cobalt in an amount of from about 1 to about 12 percent by weight of composition. The powder preferably contains tungsten carbide in an amount of from about 94 to about 99 percent by weight of composition and cobalt in an amount of from about 1 to about 6 percent by weight of composition.

Greenware Fabrication

Selection of a procedure for conversion of the powder into greenware is not particularly critical and depends largely upon desired shape of the greenware. Uniaxial pressing in hard tooling, dry or wet bag cold isostatic pressing in rubber tooling, extrusion and injection molding are all used to form greenware in the hardmetals industry. For purposes of the present invention, uniaxial pressing in hard tooling, and dry or wet bag cold isostatic pressing in rubber tooling produce satisfactory results.

Thermal and Chemical Processing

Before a pressed greenware article can be consolidated, it must first be simultaneously processed to remove binders and partially sintered to ease subsequent handling. This is beneficially accomplished by programmed heating in a furnace under reduced pressure with an inert gas atmosphere or with a reducing gas atmosphere. Vacuum Industries, Inc. supplies a suitable furnace. A particularly suitable heating program consists of a vacuum dewax step at about 350° Centigrade (hereinafter "° C."), a hydrogen reduction step at about 450° C., and a high vacuum presinter step at a temperature of from about 1200° C. to about 1400° C.

Densification and Part Recovery

Densification or consolidation of partially sintered greenware is suitably accomplished by a procedure known as Rapid Omnidirectional Compaction (hereinafter "ROC"). Timm (U.S. Pat. No. 4,744,943), Lizenby (U.S. Pat. Nos. 4,656,002 and 4,341,557), Rozmus (U.S. Pat. No. 4,428,906) and Kelto (*Metals Handbook,*

"Rapid Omnidirectional Compaction", Volume 7, pages 542–546) all teach various aspects of the ROC process. These teachings are incorporated herein by reference. Timm (U.S. Pat. No. 4,744,943) also teaches recovery of densified materials resulting from consolidation of the partially sintered greenware.

The ROC process employs a fluid die assembly to convert a uniaxial force into a high hydrostatic and isostatic pressure to effect consolidation of the partially sintered greenware. A fluid die assembly consists of a glass/ceramic shell which contains the greenware in a bath of molten glass during forging or application of the uniaxial force. The shell must have sufficient strength to withstand thermal shock and handling while being heated to a forging temperature. The shell must also have sufficient plasticity to virtually eliminate a tendency to crack or rupture during forging. The shell suitably contains a thin steel liner which protects the enclosed greenware from attack by ingredients of the shell at elevated temperatures. This liner also facilitates segregation and recovery of the glass pressure transmitting medium.

Prior to application of the uniaxial force by an apparatus or means such as a hydraulic forging press, the fluid die assembly containing the partially sintered greenware is heated in an inert atmosphere to a temperature suitable for forging. The temperature, which varies depending upon composition of the greenware and the glass pressure transmitting medium, is attained in a period of from about two to about three hours. Temperature control, e.g., by use of disposable thermocouples, assures attainment of a uniform temperature with minimal thermal history.

Timm (U.S. Pat. No. 4,744,943), whose teachings are incorporated herein by reference, discloses combinations of time, temperature and pressure suitable for purposes of the present invention. Illustrative temperatures vary from about 400° C. to about 2,900° C. Typical pressures range from about 68.9 to about 3,450 megapascals (MPa). Time may vary from as long as one hour to as short as twenty seconds or less. As a general rule, the temperature is below the liquidus temperature of the material being densified, the pressure is high enough to effect consolidation without fracturing the material and the time is as short as possible consistent with achieving adequate densification.

Following densification, the forged fluid die assemblies containing tungsten carbide/cobalt parts are beneficially air cooled to room temperature. This takes 4–6 hours and is consistent with the cooling rates utilized throughout the hardmetals industry. Cooling at these rates results in a cobalt phase composition that is not in thermodynamic equilibrium. Consequently, binder phase compositions predicted by the phase diagram are rarely realized in practice.

Part recovery may be accomplished by any means which maximizes recovery of undamaged parts. The means should, where feasible, also maximize recovery of the glass pressure medium.

Microstructures of the densified materials are suitably characterized by the degree of liquid-phase sintering which occurs at the presinter and ROC temperatures. Processing at temperatures below the cobalt liquidus, also referred to as the solid state ROC (SS/ROC) process, is believed to be most applicable to low cobalt grades of tungsten carbide. The term "low cobalt grades", as used herein, refers to compositions containing less than about three percent cobalt, based upon total composition weight. The microstructure is characterized by an absence of the angular carbide grains precipitated during liquid-phase sintering and a high degree of contiguity. It looks like a pile of compacted rubble. Since little liquid phase is present during this processing technique, carbide grain growth is absent and the resulting carbide composites are exceptionally hard.

Carbide grains in the foregoing microstructure have a mean grain size which is suitably less than about five microns. The mean grain size is beneficially less than about 2.5 microns and desirably less than about one micron.

In contrast to the SS/ROC approach, the carbide compacts may be liquid-phase sintered to nearly full density before or during the ROC forging step (hereinafter referred to as (LPS/ROC). By presintering the carbide to nearly full density at temperatures well above the cobalt liquidus, a microstructure typical of liquid-phase sintered carbide results. When operated in this mode, the ROC forging step is used to squeeze residual porosity from the composite, similar to what is accomplished in the sinter plus hot isostatic press (sinter+HIP) process. As in the sinter+HIP process, the temperature of the ROC step must be carefully controlled, or all that is accomplished is squeezing the liquid cobalt into the residual porosity instead of densifying the entire structure. However, cobaltfilled voids are much less likely to initiate a crack in a stressed piece than are empty voids, so that strength statistics are significantly improved by the ROC step even at excessive temperatures.

The ROC isostatic forging process can be operated in a spectrum of modes based on preprocessing and forging temperatures. When operated above the cobalt liquidus temperature, a product microstructure geometrically similar to that produced through the liquid-phase sinter+HIP process results. When operated below the cobalt liquidus temperature as a solid-state process, a unique, fully dense, very fine-grain microstructure results. The intrinsic properties of the composite produced by both variants of the process can be as good as any of those demonstrated by any similar material from any source. The extrinsic properties of material produced by the LPS/ROC process is a match for the finest material produced by the sinter+HIP process. The material produced by the SS/ROC process is unique and somewhat like material produced by explosive compaction.

The consolidated materials disclosed herein are suitable for use in fabricating cutting tools for machining a variety of metals and other materials. Because of the similarity in structure, the materials may also be suitable for making cutting tools used in the mining and drilling industries.

The following examples are solely for purposes of illustration and are not to be construed as limiting the scope of the present invention. All parts and percentages are by weight unless otherwise stated. Arabic numerals represent examples within the scope of the present invention and alphabetic letters designate comparative examples.

EXAMPLE b 1

Preparation of Consolidated Material via ROC

Grade mix powder, commercially available from GTE Products, Inc., Towanda, Penna., is uniaxially pressed in hard tooling at a pressure of twelve tons per square inch (165 MPa) to form near net shape greenware. The hard tooling is essentially a punch and die set used in a press. Examples of hard tooling are provided by Kenneth J. A. Brookes in FIGS. 2.37 through 2.44, pages 30–31, of *Cemented Carbides for Engineers and Tool Users,* International Carbide Data (1983). The relevant teachings from these pages are incorporated herein by reference. The powder has a nominal composition as follows tungsten carbide—93.8%
vanadium carbide—0.2%
cobalt—6.0%.

The powder, in its commercial form, comprises 98 percent of the foregoing composition and 2 percent paraffin wax.

After pressing, the greenware is placed in a vacuum furnace, commercially available from Vacuum Industries, Inc. The greenware is heated to remove the paraffin wax by increasing the furnace's temperature setting in a series of steps to a temperature of 350° C. and maintaining that temperature for a period of twelve hours. The furnace is first heated to a temperature of 100° C. and held at that temperature for a period of one hour under a reduced pressure or vacuum of from one to three pascals. While maintaining the same vacuum, the temperature is then increased to 200° C. over a period of one and one-half hours and held at that temperature for a period of one and one-half hours. With the same reduced pressure, the temperature is increased to 350° C. over a period of two hours and held at that temperature for a period of 12 hours. With no change in the vacuum, the temperature is increased to 450° C. over a period of two hours and held at that temperature for a period of four hours. The vacuum is then changed to a reduced pressure of about five pascals and the temperature is increased to 1150° C. over a period of two hours and then increased to 1400° C. over a period of two hours and held at that temperature for a period of one hour. With no change in the vacuum, the temperature is reduced to 900° C. over a period of two hours and then to ambient temperature over an additional two hour period. This period of heating is sufficient to partially sinter the greenware thereby facilitating further handling and markedly reducing its reactivity with air during subsequent processing.

Several pieces of the partially sintered greenware are converted to densified products via pressure consolidation in accordance with the teachings of Lizenby (U.S. Pat. No. 4,656,002) and Timm (U.S. Pat. No. 4,744,943), both of which are incorporated herein by reference. Except as modified herein, the procedure disclosed by Timm in Example 1 is used to prepare the densified products. The pieces of greenware are placed in a fluid die containing a steel liner, packed with glass cullet (Pyrex type glass) and heated in a nitrogen purged box furnace to a temperature of 1275° C. and held at that temperature for 15 minutes. The fluid die and its contents are then transferred to a hydraulic forging press and consolidated at a temperature of 1275° C. under an applied pressure of 120,000 psi (827 MPa) with a pressure dwell time of 20 seconds.

The can containing the densified products is removed from the composite shell after the shell is cooled in air to room temperature over a period of about six to eight hours. The can is then crushed in a jaw crusher to free the densified products from most of the solidified glass. Residual glass is removed from the densified parts by dissolving in caustic in a Kolene® bath. Kolene® is a trademark of the Kolene Corporation, a manufacturer of molten caustic cleaning equipment for the forging industry.

After recovery, a piece of the densified product is machined into an American National Standards Institute (ANSI) Type TPG-544 cutting tool insert by diamond grinding for comparison with a commercially available Type TPG-544 cutting tool insert made of type H-21, non-coated hardmetal. The commercially available insert (hereinafter "Comparative Example A") is provided by Teledyne Firth Stirling, Inc., La Vergne, Tennessee and has a nominal composition as follows:

tungsten carbide—93.5%
tantalum(niobium) carbide—0.5%
cobalt—6.0%.

The composition of Comparative Example A is nearly identical to that of Example 1. Comparative Example A has a slightly larger amount of grain growth inhibitor than Example 1–0.5% as opposed to 0.2%. In addition, Comparative Example A uses a different grain growth inhibitor than Example 1 - tantalum(niobium) carbide as opposed to vanadium carbide. These differences are believed to be of little consequence.

Teledyne Firth Stirling reports the following physical properties for Comparative Example A:

Transverse rupture strength—1800 $N/mm^2$ (256 ksi)
Density—14.85 $g/cm^3$
Hardness—Rockwell A Scale (HRA)—92.1

The inserts, Example 1 and Comparative Example A are tested on a Gidding and Lewis Type 32H horizontal lathe. The inserts are used to rough turn a 23.8 inch diameter (60.45 cm) aerospace forging made from a titanium alloy (Ti-6Al-2Sn-4Zr-6Mo) at a speed of 157 surface feet per minute (SFPM) (48 surface meters per minute, a feed rate of 0.0065 inches (0.17 cm) per revolution, a pass length of 1.0 inch (2.54 cm), a depth of cut of 0.50 inch (1.27 cm). A water soluble flood is used for cooling. Indexing or replacing the cutting edge is deemed appropriate when flank wear reaches 0.015 inch (0.038 cm). The type H-21 insert (Comparative Example A) must be replaced or indexed to provide a new cutting edge after one pass. The insert of Example 1, on the other hand, wears more slowly and makes eight passes before requiring indexing. In other words, the wear resistance of the Example 1 insert is much greater than that of the Comparative Example A insert. The minor bulk composition differences would not, it is believed, suggest such a large difference in cutting performance. Similar results are expected with other compositions of the present invention.

COMPARATIVE EXAMPLE B

Preparation of Consolidated Material via Liquid Phase Sintering

A portion of the same grade mix powder as used in Example 1 is consolidated via liquid phase sintering in accordance with the procedure suggested by Kenneth J. A. Brookes, *Cemented Carbides for Engineers and Tool Users.* International Carbide Data (1983), pages 17–18, the relevant teachings of which are incorporated herein by reference. Mr. Brookes suggests that straight tungsten carbide/cobalt graded indexable inserts are beneficially sintered via batch-type, low pressure or vacuum sintering. Sintering is accomplished in one hour at a temperature of 1450° C. as suggested in the foregoing reference at Table 2.1, page 17.

Bulk Chemical Analysis

Pieces of Example 1 and Comparative Examples A and B are analyzed to determine their bulk chemical composition in terms of tungsten carbide (WC), cobalt (Co), grain growth inhibitor (GGI), and total carbon content (Carbon). As noted hereinabove, the grain growth inhibitor for Example 1 and Comparative Example B is vanadium carbide whereas that in Comparative Example A is tantalum(niobium) carbide. The analysis is summarized in Table I.

TABLE I

| Sample/ Parameter | Bulk Chemistry Example 1 | Comparative Example A | Comparative Example B |
|---|---|---|---|
| WC | 93.8 | 93.5 | 93.8 |
| Co | 6.0 | 6.0 | 6.0 |
| GGI | 0.2 | 0.5 | 0.2 |
| Carbon | 5.75 | 5.82 | 5.75 |

The data presented in Table I show that the bulk chemistry of the pieces is nearly identical. The minor differences, particularly in total carbon content, are not believed to be significant The differences are also not believed to contribute substantially to the marked difference in wear resistance noted herein with respect to Example 1 and Comparative Example A.

Geometric Comparison of Microstructures

Pieces of Example 1 and Comparative Examples A and B are examined using Scanning Electron Microscope images taken at a magnification of 10,000 after the pieces are mounted, polished and etched with Murakami's Reagent, a well known reagent described in ASTM B-65779, "Metallographic Determination of Microstructure in Cemented Carbides. The examination focuses on four parameters which can be measured by lineal analysis:

f—volume fraction of binder:

Λ—mean free path in the binder phase or binder layer thickness:

d—linear intercept size of carbide grains: and

C—contiguity of carbide grains.

A more complete description of the parameters is presented by H. C. Lee and J. Gurland in "Hardness and Deformation of Cemented Tungsten Carbide", *Materials Science and Engineering,* 33 (1978), pages 125–33, the teachings of which are incorporated herein by reference. Table II presents the parameters for each of the pieces

TABLE II

| Sample/ Parameter | Geometric Comparison Data Example 1 | Comparative Example A | Comparative Example B |
|---|---|---|---|
| f | 0.092 | 0.091 | 0.093 |
| d | 0.44 | 0.69 | 0.38 |
| C | 0.65 | 0.68 | 0.67 |
| λ | 0.12 | 0.27 | 0.12 |

The data presented in Table II discloses nothing startling about the geometry of these microstructures. In fact, the substantial similarities in binder volume fraction and contiguity suggests that performance advantages might have something to do with mechanical properties of the binder phase.

Mechanical Data Comparison

Pieces of Example 1 and Comparative Examples A and B are subjected to testing under American Society for Testing and Materials (hereinafter "ASTM") tests as Porosity—ASTM B-276–79:

Density—ASTM B-311–58 (grams per cubic centimeter or g/cc):

Strength—ASTM B-406–76 (ksi or MPa): and

Hardness—ASTM B-294–76 (Rockwell A).

The data are summarized in Table III.

TABLE III

| Sample/ ASTM Property | Mechanical Data Example 1 | Comparative Example A | Comparative Example B |
|---|---|---|---|
| Porosity | A014 | A011 | A004 |
| Density | 14.9 | 14.9 | 14.9 |
| Strength | 495 | 260* | 360 |
| Hardness | 93.4 | 92.1* | 93.4 |

*means Manufacturer's Data

The data summarized in Table III shows that the material of the present invention has a strength almost double that of the commercially available material (Comparative Example A) and significantly higher than that of the same starting composition prepared via liquid phase sintering. The data also lends credence to an observation that performance differences, at least in terms of wear resistance, may be due largely to the process used to prepare the materials.

Binder Phase Chemistry Determination

Binder phase domains within pieces of Example 1 and Comparative Examples A and B are examined via one of two analytical techniques depending upon size of the areas of binder phase within the pieces. Analytical Transmission Electron Microscopy (ATEM) is used for binder phase (cobalt) areas less than about 0.5 microns in diameter. Electron Microprobe Analysis (EPA) is used for binder phase (cobalt) areas greater than about 0.5 microns in diameter. The data gathered from this examination are shown in Table IV and graphically portrayed in Figure I.

TABLE IV

| Cobalt Phase Size | Binder Phase Chemistry: Weight Percent of Tungsten in Cobalt Phase Example 1 | Comparative Example A | Comparative Example B |
|---|---|---|---|
| 0.1 | — | 14 | 14 |
| 0.2 | 10.2 | — | — |
| 0.4 | — | 12.6 | — |
| 1.0 | 5.4 | 10.6 | — |
| 1.25 | — | — | 11.0 |
| 1.5 | 5.8 | — | — |
| 2.0 | 5.3 | 11.1 | — |
| 2.5 | — | 10.0 | — |
| 3.0 | 4.5 | 10.9 | — |
| 4.0 | — | 10.6 | — |
| 4.75 | — | 10.5 | — |
| 6.5 | — | 10.3 | — |
| 8.0 | — | 9.3 | — |
| 9.0 | — | 10.6 | — |

— not measured

A brief examination of the FIGURE highlights two very significant points First, binder (cobalt) phase domains or pools for the material of Example 1 contain much less tungsten than those of either Comparative Example. Second, Comparative Examples A and B, notwithstanding the small number of data points for Comparative Example B, appear to have nearly identical binder phase chemistry. From this, one could surmise that Comparative Example A is also prepared via liquid phase sintering.

The binder phase chemistry differences cannot be attributed to variations is bulk chemistry. As noted in Table I, the overall bulk chemistry of Example 1 and Comparative Examples A and B are virtually identical. It is believed that differences in binder chemistry are primarily attributable to processing differences between Rapid Omnidirectional Compaction, in the case of Example 1, and Liquid phase sintering, in the case of Comparative Examples A and B. In other words, by keeping temperatures comparatively low, at least with regard to sintering temperatures, times short, again in comparison to those commonly used in sintering, and pressures high, on the order of 100,000 psi as opposed to low pressure or vacuum sintering, one can produce a unique and useful microstructure with a low alloy binder.

Similar results are expected with other compositions of the present invention. Similar results may also be attained with hot isostatic pressing.

What is claimed is:

1. A substantially fully dense article of manufacture suitable for use in cutting tool applications, said article being formed from a powdered composition comprising tungsten carbide in an amount of from about 82 to about 99 percent by weight of composition and cobalt in an amount of from about 1 to about 18 percent by weight of composition and having a unique microstructure, the microstructure comprising tungsten carbide grains having a mean grain size of less than about five microns, and a binder phase, the binder phase being substantially free of graphite and complex, intermetallic carbides and comprising, tungsten, cobalt and carbon, the tungsten in the binder phase being present in an amount of less than about eighty percent of that present in the binder of an article prepared by liquid phase sintering the same powdered composition at a temperature sufficient to provide substantially complete densification in the absence of external pressure.

2. The article of claim 1 wherein the binder phase further comprises at least one grain growth inhibitor.

3. The article of claim 2 wherein the amount of grain growth inhibitor is between and about 0.5 percent by weight of the powdered composition.

4. The article of claim 2 wherein the grain growth inhibitor is selected from the group consisting of vanadium carbide, molybdenum carbide, cesium carbide, niobium carbide, tantalum carbide, titanium carbide, zirconium/hafnium carbide and tantalum(niobium) carbide.

5. The article of claim 1 wherein the powdered composition comprises tungsten carbide in an amount of from about 85 to about 99 percent by weight of composition and cobalt in an amount of from about 1 to about 15 percent by weight of composition.

6. The article of claim 1 wherein the powdered composition comprises tungsten carbide in an amount of from about 88 to about 99 percent by weight of composition and cobalt in an amount of from about 1 to about 12 percent by weight of composition.

7. The article of claim 1 wherein the powdered composition comprises tungsten carbide in an amount of from about 94 to about 99 percent by weight of composition and cobalt in an amount of from about 1 to about 6 percent by weight of composition.

8. The article of claim 1 wherein the unique microstructure is attained by consolidation of the powdered composition via rapid omnidirectional compaction.

9. The article of claim 1 wherein the unique microstructure is attained by consolidation of the powdered composition via hot isostatic pressing.

10. The article of claim 8 wherein the powdered composition is formed into greenware which is partially sintered in a reactive gaseous atmosphere or under reduced pressure in an inert gaseous atmosphere prior to consolidation.

11. The article of claim 1 wherein the tungsten carbide grains have a mean grain size of less than about 2.5 microns.

12. The article of claim 1 wherein the tungsten carbide grains have a mean grain size of less than about one micron.

* * * * *